United States Patent [19]

Larson

[11] 4,422,306

[45] Dec. 27, 1983

[54] GARMENT ATTACHMENT INCLUDING OPENABLE ENCLOSURE

[76] Inventor: Ted Larson, P.O. Box 22, San Martin, Calif. 95046

[21] Appl. No.: 956,340

[22] Filed: Oct. 31, 1978

[51] Int. Cl.[3] ..... A44C 25/00

[52] U.S. Cl. ..... 63/1 R; 224/182

[58] Field of Search ..... 63/20, 2, 1 R; 224/182; 24/13; 40/1.5, 1.6

[56] References Cited

U.S. PATENT DOCUMENTS

| | | | |
|---|---|---|---|
| 1,623,693 | 4/1927 | Logan | 40/1.6 |
| 2,144,926 | 1/1939 | Lawton | 63/20 X |
| 2,401,556 | 6/1946 | DiStiso | 63/2 |
| 2,850,818 | 9/1958 | Brownstein | 40/1.5 |
| 2,867,815 | 1/1959 | Wittenberg | 40/1.5 X |
| 3,430,829 | 3/1969 | Wilson et al. | 40/1.5 X |
| 3,942,273 | 3/1976 | Adams | 40/1.5 |
| 3,953,910 | 5/1976 | Farb | 40/1.5 X |

*Primary Examiner*—F. Barry Shay

*Attorney, Agent, or Firm*—Jack M. Wiseman

[57] ABSTRACT

This attachment for garments is adaptable to be removably secured to either the sleeves, or the breast pocket of a jacket, coat, or other garment, and it consists primarily of an elongated plate, having a decorative face on one side, and it includes, on its other side, means, for securing it to a garment. The attachment may include a rearward storage enclosure that is opened and closed by sliding the plate relative thereto. The attachment may be used to replace the row of buttons conventionally used on the sleeve of a garment.

3 Claims, 6 Drawing Figures

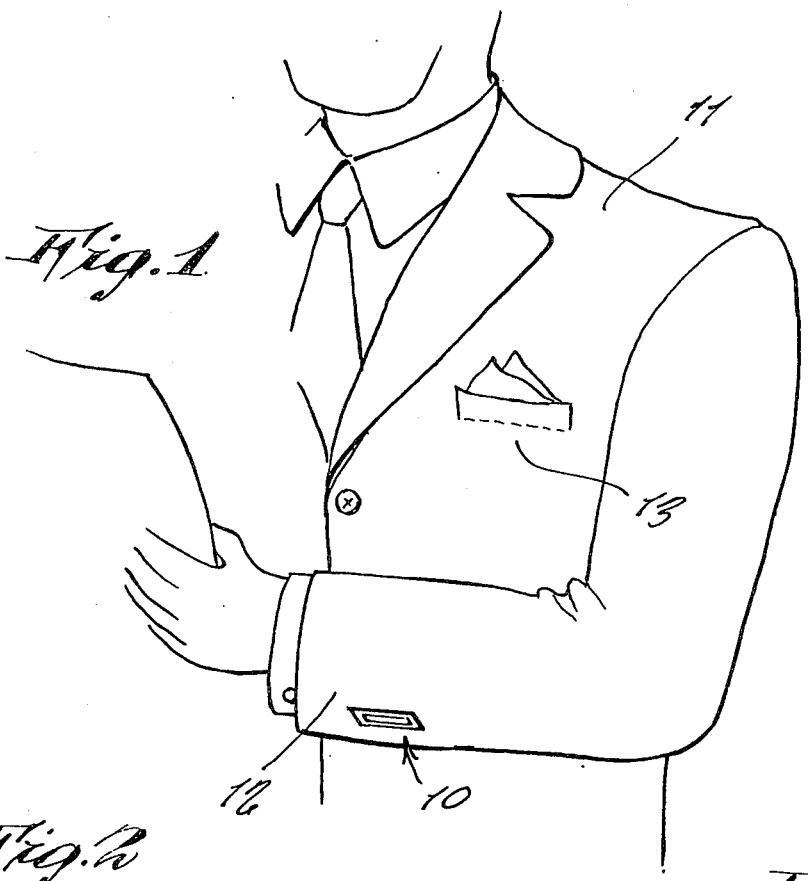
Fig. 1
Fig. 2
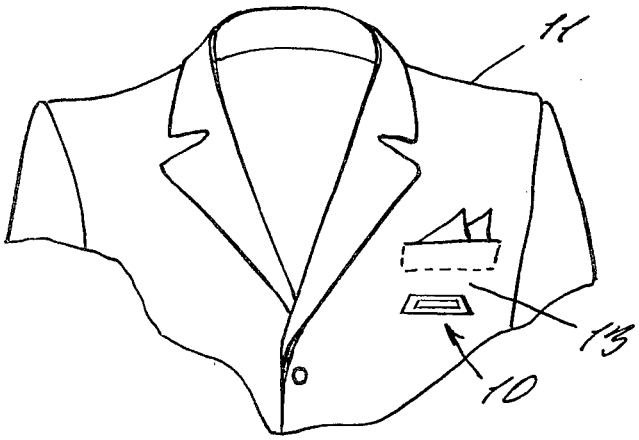
Fig. 3
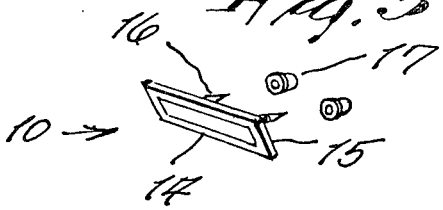
Fig. 4
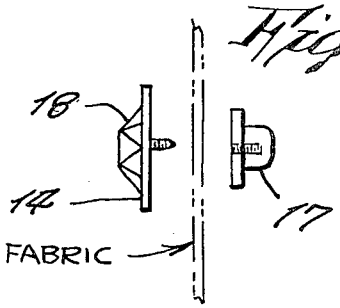
Fig. 5
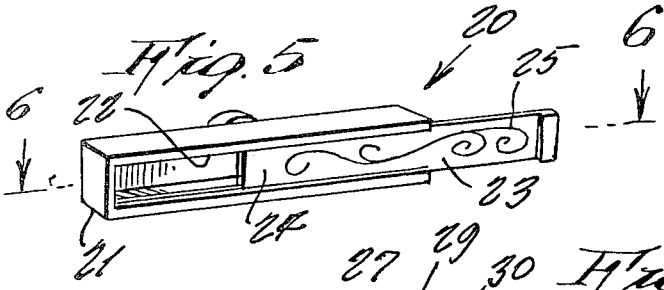
Fig. 6
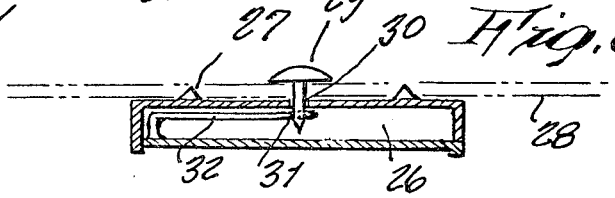

GARMENT ATTACHMENT INCLUDING OPENABLE ENCLOSURE

This invention relates to devices for garments, and more particularly, to an attachment for garments.

It is, therefore, the primary object of this invention to provide an attachment for garments, which will be unique and novel, and it may be removably received on garments, such as on the sleeves or breast thereof.

In the prior art, the custom was to have a row of two, or more, buttons secured to the sleeves of garments, so as to serve as ornamentation. The aforementioned custom has prevailed for centuries, thus, there is a need for a change in this ornamentation art, particularly by those who are constantly aware of style changes, so as to be impeccably dressed.

Accordingly, another object of this invention is to provide an attachment for garments, which will be removably secured to a sleeve, or breast of a garment, and it will serve to replace such ornaments as rows of buttons.

Another object of this invention is to provide an attachment for garments, which will be adaptable for use on either men's, or women's coats, jackets, or blouses.

A further object of this invention is to provide an attachment for garments, which may be worn on the shoulders of a garment, for ornamentation, and the present invention may be fabricated in matched sets, so as to enable them to be worn upon the sleeves, simultaneously, as well as upon other areas of the garment.

A still further object of this invention is to provide an attachment for garments, which may be removed from one garment, and then secured to another garment, when a person changes clothing, and it may be employed as a personal, monogrammed ornament.

An even further object of this invention is to provide an attachment for garments, which is adaptable by modification thereof, to serve as a secret enclosure for carrying paper currency, for use in an emergency.

Other objects of the invention are to provide an attachment for garments, which is simple in design, inexpensive to manufacture, and easy to attach and unattach thereto.

These, and other objects, will become readily evident, upon a study of the specification, and the accompanying drawing, wherein:

FIG. 1 is a perspective view of the invention, shown secured to a sleeve cuff of a garment;

FIG. 2 is a front view of the invention, shown secured to the breast of a garment;

FIG. 3 is an exploded perspective view of the invention, shown removed from the garment;

FIG. 4 is a modified end elevational view of the invention, showing a diamond face plate design, separated from the fasteners, and the fabric is illustrated in phantom;

FIG. 5 is a perspective view of another modified form of the invention, which is hollow, so as to hide paper currency, and FIG. 6 is a cross-sectional view, taken along the line 6—6 of FIG. 5.

According to this invention, an attachment 10 is shown secured to jacket 11, upon the sleeve 12, or it may be secured to the breast pocket 13 thereof.

The attachment 10 includes a rectangularly configurated plate 14, which is decorative upon its front side, and, included on its rear side 15, are a pair of threaded prongs 16, which are relatively short and pointed. Prongs 16 removably receive a threaded cap nut fastener 17.

The prongs 16 are of such length, that they will pass through jacket 11 fabric, whereupon the fasteners 17 may engage prongs 16, and the fasteners 17 will abut with the inner side of the fabric, while the plate 14 is on the outer side. As is readily evident, attachment 10 may be quickly and easily detached from one portion of jacket 11, so as to be secured on another portion thereof, or it may be mounted upon another garment.

It shall be noted, that, in securing attachment 10 upon sleeve 12, the conventional buttons are removed therefrom.

It shall also be noted, that attachment 10 may be fabricated from a wide range of materials, such as plastic, aluminum, steel, or of precious metals, as desired.

As illustrated in FIG. 4, the front side of plate 14 may have jewelry stones 18 set therein, such as diamonds, or other semi-precious stones. The front surface may alternately be engraved, or otherwise enameled in various colors, so as to be readily adaptable to numerous garments, for pleasing both men and women.

It shall further be noted, that attachment 10 should have a favorable market, particularly by custom tailors, coat and suit manufacturers, jewelry and department stores, and novelty stores.

Referring now to FIGS. 5 and 6, a modified attachment 20 is shown to include a shallow and hollow enclosure 21, having an opening 22 upon its front side, that is closeable by means of a sliding plate 23, that, upon its front side, is attractively decorated, such as by engraving 25, the aforementioned stones, or other decoration. The interior space 26 serves as storage means for emergency currency, or other object, as desired by the wearer. The rear side of the enclosure includes a pair of extending projections 27, that are pointed, which extend the depth of the fabric 28, in order that they do not extend therethrough, but which are sufficiently long, so as to firmly hold attachment 20 against fabric 28, without rotation about a single, central mounting pin 29, that extends through an opening 30 in the rear wall of the enclosure, and it is screw engaged in a threaded opening 31 of a tab 32 integral with a rear side of the front plate 23.

It shall be recognized, that the mounting pin 29 serves to support the attachment 20 to the garment, and simultaneously, maintains the sliding plate in a closed position, so as to prevent accidental opening of the enclosure, and loss of the object contained therein. As shown in FIG. 5, the plate 24 slides in longitudinal grooves on opposite sides of the enclosure opening, the outwardly slidable end of the plate including a lip on its end for easy pulling grasp, and the lip completing an appearance of a frame around the edges of the plate when in a closed position. Also, as shown in FIG. 6, it is to be noted that the tab 32 is angle-shaped, so as to extend adjacent the enclosure rear wall, and also adjacent one end wall of the enclosure when closed, so as not to cut across the interior space 26.

While various changes may be made in the detail construction, it is understood that such changes will be within the spirit and scope of the present invention, as is defined by the appended claims.

What I now claim is:

1. An attachment for garments comprising a hollow enclosure member adapted for use as a storage means having a front side and another side, an opening at said front side, means movably attached to said enclosure member to close and open said front side, said movable means including a movable member having a decorative side facing away from said opening and an apertured portion located within the opening when said movable means closes said front side; means for remvably securing said attachment to a garment and simultaneously securing said movable means in closed relation including a wall at said other side, an aperture in said wall, means for penetrating said garment, passing through said wall aperture and entering said portion aperture, and means for detachably retaining said penetrating means in said garment and apertures.

2. An attachment for garments, comprising, in combination, a rectangularly configurated plate with decorations on a front side thereof, and means on a rear thereof for removable securement to a fabric of a garment, in place of decorative rows of buttons; a shallow, box-like enclosure having an opening on its front side, said plate comprising a slidable cover closing said opening, said removable securement means comprising an angle-shaped tab integral with said plate rear side, said tab extending inside said enclosure, a threaded hole near an end of said tab, said threaded hole being in alignment with a clearance hole in a rear wall of said box-like enclosure, when said plate is in a fully closed position in said enclosure front side opening, and a pointed pin having an enlarged head on one end, said pin being insertable from an inner side of a garment through said clearance hole and engageable in said threaded hole.

3. The combination as set forth in claim 2, wherein said enclosure rear wall includes a pair of spaced-apart, rearwardly pointed projections, for anchoring in said garment fabric.

* * * * *